US005127740A

United States Patent [19]

DeBoer

[11] Patent Number: 5,127,740

[45] Date of Patent: Jul. 7, 1992

[54] CONCRETE RECLAMATION SYSTEM AND METHOD FOR UTILIZING SAME

[75] Inventor: Richard D. DeBoer, Oak Lawn, Ill.

[73] Assignee: Resource Recovery Systems, Inc., Alsip, Ill.

[21] Appl. No.: 725,028

[22] Filed: Jul. 3, 1991

[51] Int. Cl.[5] ..... B28C 5/00

[52] U.S. Cl. ..... 366/2; 220/504; 220/553; 366/15; 366/54

[58] Field of Search ..... 366/14, 15, 1, 2, 6, 366/26, 27, 28, 30, 39, 54, 55, 60, 62, 63, 220; 222/572; 220/504, 553, 555, 557

[56] References Cited

U.S. PATENT DOCUMENTS

| | | | |
|---|---|---|---|
| 2,299,702 | 10/1942 | Mosel | 220/553 |
| 2,942,731 | 6/1960 | Soldini | 209/293 |
| 3,596,759 | 8/1971 | King | 106/713 |
| 3,695,427 | 10/1972 | Friesz | 209/44 |
| 3,997,434 | 12/1976 | Macauley | 209/250 |
| 4,792,234 | 12/1988 | Doherty | 366/14 |
| 4,964,917 | 10/1990 | Bobrowski | 106/804 |

*Primary Examiner*—Robert W. Jenkins
*Attorney, Agent, or Firm*—Kinzer, Plyer, Dorn, McEachran and Jambor

[57] ABSTRACT

A system and method for reclaiming unused portions of mixed concrete by adding a chemical agent to retard the hydration state of the concrete for up to several days. When the stored concrete is again desired for use, a chemical accelerating agent is added to the mixed concrete which returns the hydration state to normal, once again allowing the concrete to set. The concrete can then be poured at a construction site or alternatively, the stored concrete can be added to a new batch of newly mixed concrete before pouring.

21 Claims, 4 Drawing Sheets

CONCRETE RECLAMATION SYSTEM AND METHOD FOR UTILIZING SAME

BACKGROUND OF THE INVENTION

1. Field of the Invention

This invention generally relates to concrete reclamation, and more particularly to methods and systems for reclaiming in a closed system unpoured concrete and other material which would normally be discarded so that no unused products are generated.

2. Background Art

Concrete reclamation is fast becoming a standard in the concrete production and construction industries. The advantages of reclaiming unneeded or unused concrete at the end of a concrete pouring cycle are clear from both an economic and an environmental position.

Various attempts in the industry providing for concrete reclamation have been described and used in the field. The following U.S. Patents are examples of these attempts: U.S. Pat. Nos. 2,942,731, No. 3,278,022, No. 3,596,759, No. 3,695,427, No. 3,997,434 and No. 4,488,815. These patents are mostly concerned with the reclamation of small quantities of concrete which remain in a "ready-mix" truck after the concrete in the truck has been discharged. The most common method disclosed by these patents is the reclamation of the slurry water, which contains small amounts of dissolved concrete, and which results when a truck or mixer has been flushed with water to clean out the mixing chamber. The majority of these patents are concerned with the separation of the cement slurry into its water, sand and gravel constituents.

As often happens at a building site, however, and especially at the end of a concrete pouring job, a substantial quantity of concrete will be unused because there is no need to pour it at the job site. The amount may vary depending on the accuracy of the projections of concrete which are needed at a job site. Because the concrete is first mixed at a mixing plant and transported by a ready mix truck to a job site, the projected need for concrete will usually exceed the amount which is actually used to avoid the necessity of extra trips. The usual eventuality is the return of the ready mix truck at the end of the day with a substantial portion of the unpoured concrete still in the ready-mix truck. Thus, there is a need in the industry for a method of and system for reclaiming the unused portion of the concrete for future use.

One problem which results from storage of concrete for use during the next day's concrete pour is that concrete left standing for a sufficient length of time will hydrate and set in position. Concrete which has set cannot be used for pouring and cannot be recycled in the normal course. Various method for retarding hydration of concrete have been proposed in the prior art, one of which is disclosed by U.S. Pat. No. 4,964,917, which is incorporated by reference herein. That patent is directed to a method and composition for retarding hydration of concrete and for reversal of the process, i.e. for acceleration of concrete hydration, when the concrete is again desired for pouring.

Even when armed with the teachings of U.S. Pat. No. 4,964,917, however, there remains the problem of bulk material handling at the ready-mix plant, especially during times of high return volume of unpoured and unused concrete, such as at the end of the day, when several trucks may be waiting to discharge excess concrete from their respective mixers.

SUMMARY OF THE INVENTION

It is therefore an object of this invention to provide a method of and a system for reclaiming large batches of unused concrete and storing the concrete in a state for a substantial predetermined period of time, and allowing the concrete to be reused after the predetermined period of time has passed.

Another object of the present invention is to provide a material handling and storage system which is capable of moving large volumes of unset and unused concrete from ready-mix trucks into a storage tank and from a storage tank to a mixer of a ready-mix truck quickly and efficiently while simultaneously minimizing waste water and concrete.

Another object of the invention is to provide an efficient and effective means of receiving, handling and discharging concrete so that all unused portions of mixed concrete and other material are saved and recycled, resulting in no waste materials.

In accordance with these objects, there is provided a system for reclaiming unused portions of mixed concrete comprising, an unloading means for discharging the unused portions of concrete from a movable mixer, a material handling bucket for receiving the unused portions of concrete from the unloading means, means for elevating and lowering the material handling bucket, means for automatically tilting the material handling bucket and for pouring the concrete contained by said material handling bucket to a desired location, a storage mixer for receiving from the material handling bucket and for storing the unused concrete, the mixer being capable of revolving, means for adding a chemical agent to the storage mixer to change the hydration state of the concrete stored in the storage mixer, means for revolving the storage mixer, and means for removing the concrete from the storage mixer and for loading the concrete into a desired receptacle.

Also disclosed a method for storing and reclaiming unused portions of concrete comprising the discharging of the unused portions of concrete from a movable mixer into a material handling bucket when the material handling bucket is in an upright position, elevating the material handling bucket to a predetermined level, automatically tilting the material handling bucket and pouring the concrete contained in the material handling bucket into at least one storage mixer which is capable of revolving, adding a chemical agent to the storage mixer to retard the hydration state of the concrete stored in the storage mixer, revolving the storage mixer so that the chemical agent is homogeneously dispersed throughout the concrete in the storage mixer, storing the unused portions of the concrete in the storage mixer for a predetermined length of time, adding an accelerating agent to the concrete in the storage mixer, revolving the storage mixer so that the accelerating agent is homogeneously dispersed throughout the concrete in the storage mixer, and removing the concrete from the storage mixer and loading the concrete into a desired receptacle.

DETAILED DESCRIPTION OF THE PREFERRED EMBODIMENT

Figure 1:
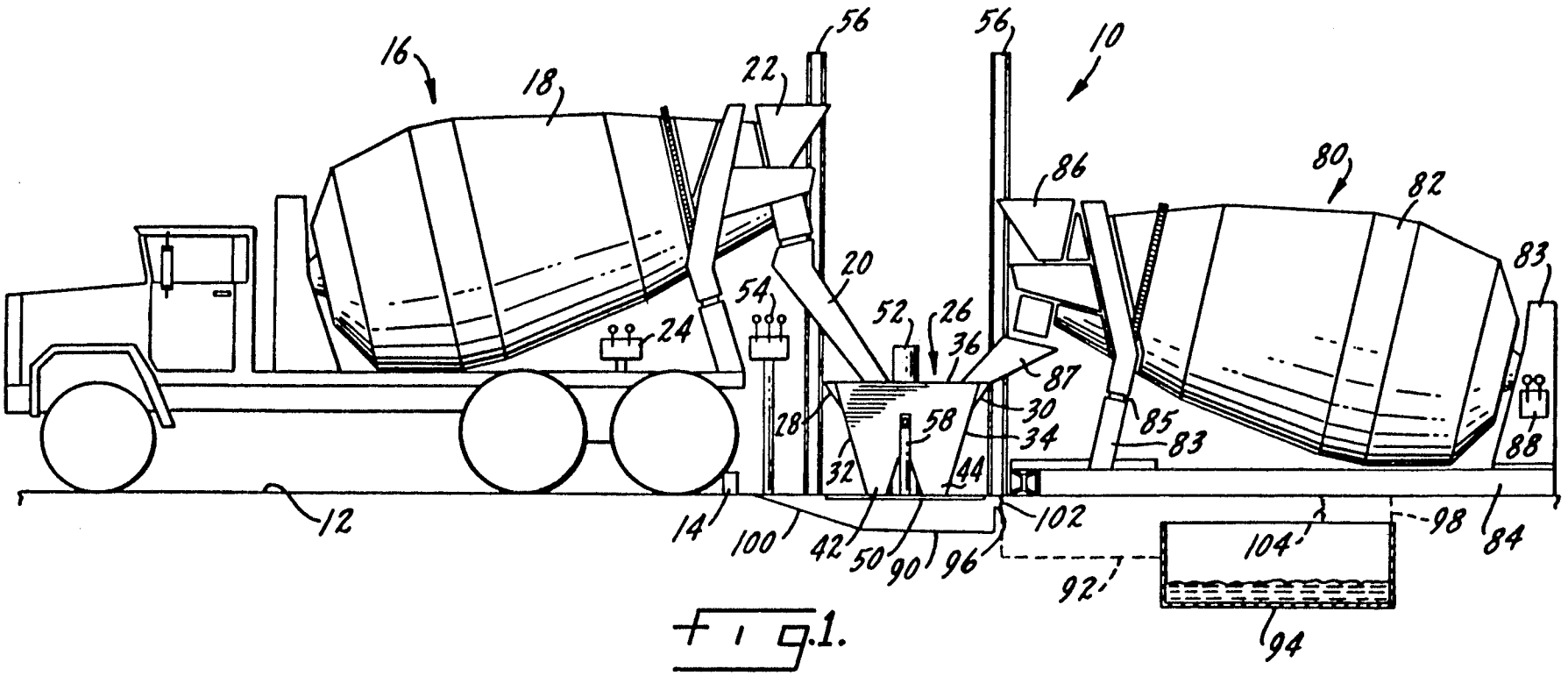
FIG. 1 is an elevational view of the system according to the present invention.

Referring now to FIGS. 1-6, wherein each of the identical elements are indicated by identical reference numerals, there is illustrated a system 10 for reclaiming and storing unused portions of concrete, which are returned by ready-mix concrete trucks returning from construction sites where the originally loaded full loads of concrete were not needed for use at the construction site.

System 10 comprises a loading dock 12 having a guide 14 into which a ready-mix concrete truck 16 can be guided. The ready-mix truck 16 will normally have a truck mixer 18, chute 20, hopper 22, and controls 24. The truck 16 can back up into the dock 12 until guide 14 stops further movement of the truck. Alternatively, the truck 16 can pull up alongside the dock 12 and material handling bucket 26 and discharge hopper 20 may be positioned for discharge of concrete into material handling bucket 26.

Figure 2:
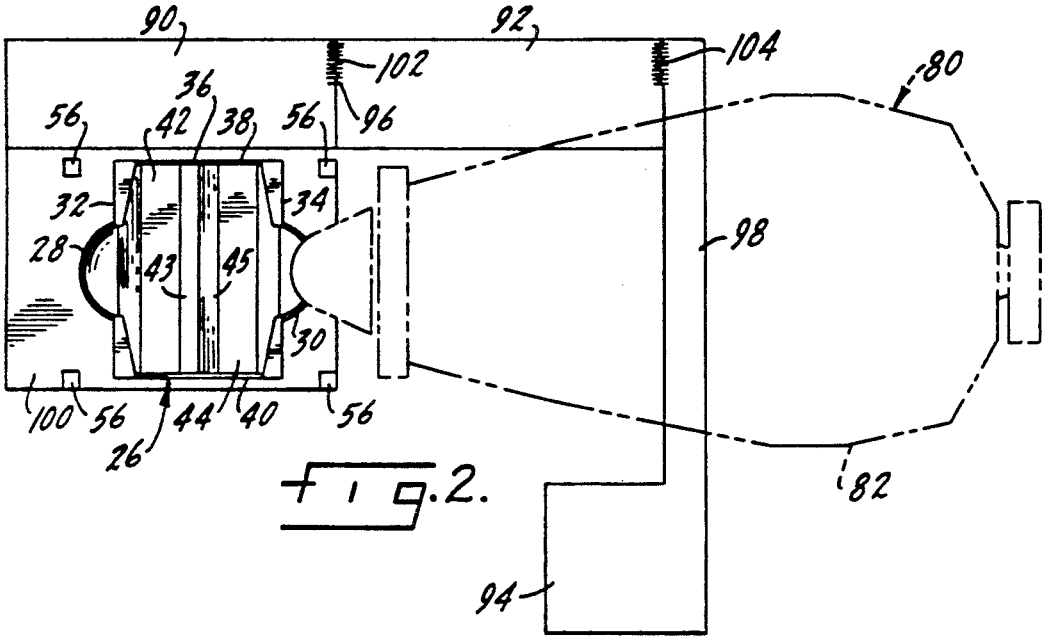
FIG. 2 is a top view of the system according to the present invention.
Figures 3A, 3B, 3C, 3D:
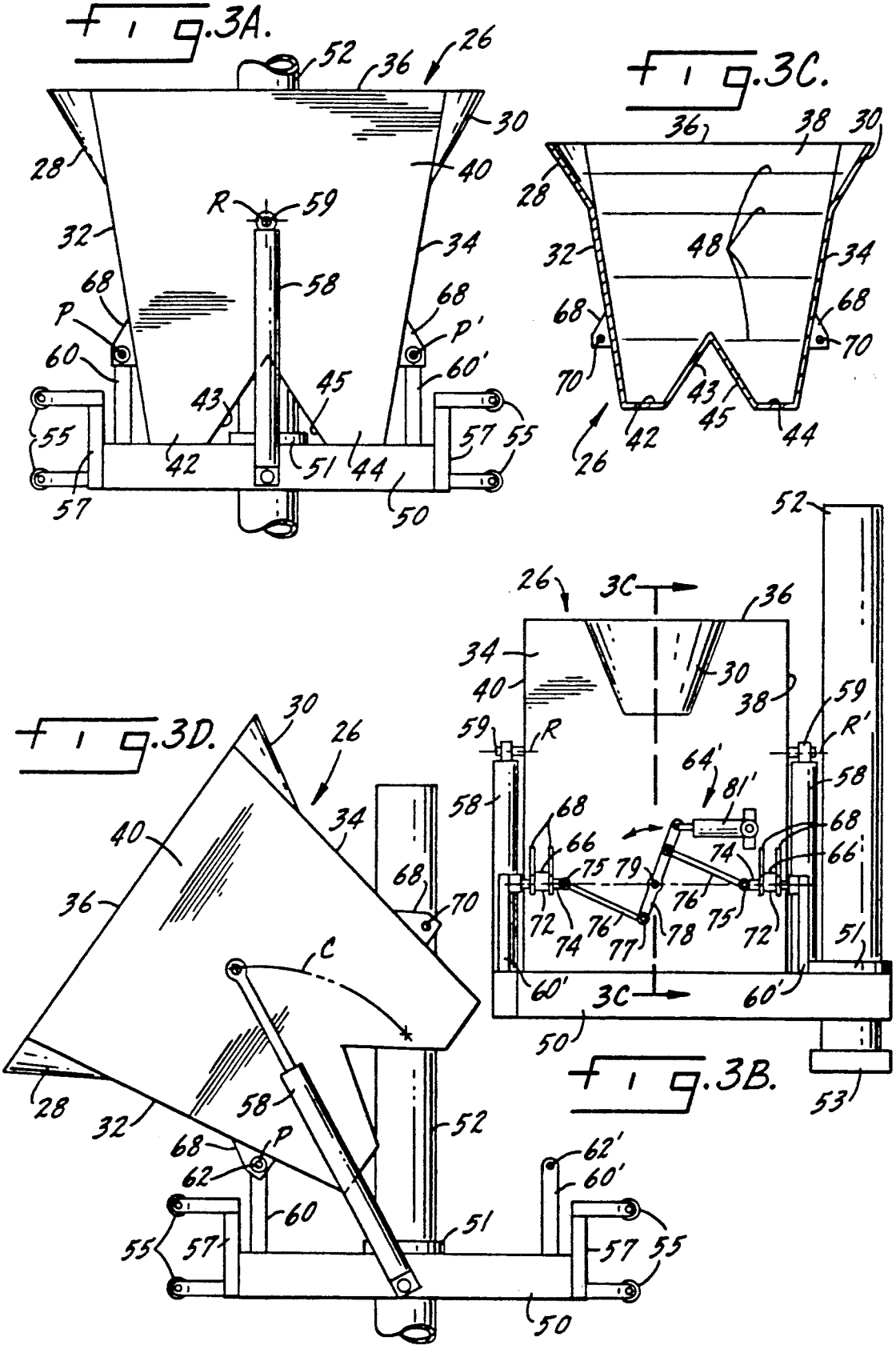
FIGS. 3A and 3B are detailed front and side views, respectively, of the material handling bucket in the upright position according to the present invention.
FIG. 3C is a cross-sectional view of the material handling bucket taken approximately along section line, 3C—3C of FIG. 3B.
FIG. 3D is a side view of the bucket according to the present invention when in the discharge position.

FIG. 2 is a top view of a material handling bucket 26 showing the relationship to the other elements in the system. FIGS. 3A-D illustrate in greater detail the construction of the preferred material handling bucket 26 and the relationship of the bucket construction to the operational performance of the objectives that the system is intended to achieve. FIGS. 3A and 3B are elevational front and side views, respectively, of the material handling bucket 26 and hydraulic maneuvering means by which the material handling system operates. FIG. 3C shows the bucket 26 in cross section, taken approximately along the line 3C—3C of FIG. 3B. FIG. 3D illustrates the operation and tilting of the bucket 26 through an arc C for discharge of its contents. Shifting reference between FIGS. 1, 2 and 3A-3D will best explain the construction and operational details of the various bucket elements of the bucket 26.

Material handling bucket 26 is intended to tilt and pour concrete in either of two oppositely disposed directions. Thus, the bucket construction includes two spouts 28,30 oppositely disposed on two spout walls 32 and 34, respectively, along the rim 36 of the bucket 26. As can be best seen in the top view of FIG. 2, the spouts 28,30 protrude beyond the peripheral rim 36 of the bucket 26 and facilitate the pouring of the concrete into relatively smaller apertures, such as into hopper 22 of truck 16.

The bucket 26 must also be able to efficiently and effectively discharge all of the concrete contained within it. Accordingly, each of the spout walls 32,34 are sloping relative to vertical when the bucket 26 is in an upright position. To further facilitate the pouring of the concrete in either of the two directions, the bottom wall of the bucket 26 includes two troughs 42 and 44, best seen in FIG. 3C. The spout wall 32 defines the outside wall of the trough 42 and spout wall 34 defines the outside wall of trough 44. Inside trough walls 43 and 45 complete the enclosure of the troughs 42 and 44. Bucket walls 38 and 40 define the transverse walls of both troughs 42,44 at their ends and complete the enclosure of the bucket 26 generally. Troughs 42,44 provide an efficient angular construction which will allow the easier discharge of concrete when the bucket 26 is tilted in either direction, as will be more fully described below.

Material handling bucket 26 has a metered volume, conveniently being approximately two cubic yards. Knowledge of the volume of concrete contained in the bucket 26 is necessary to provide an indication of the amount of hydration retardant and accelerant which must be added to the concrete, as is known in the art and explained in U.S. Pat. No. 4,964,917. To facilitate measurement of concrete volume, bucket 26 may include marked incremental indicators 48 at appropriate places on the inside of one or more walls of the bucket 26. Incremental indicators, which have been found to be useful in measurement, are at every one-half cubic yard, as measured from the bottom of the bucket 26. Alternatively, the bucket 26 may be mounted on a load cell (not shown) and each of the additive materials may be measured by weight rather than by volume.

The bucket elevating and tilting mechanisms of the system 10 will now be described. Bucket 26 rests on a substantially flat, movable platform 50 having a surface area slightly larger than the profile of bucket 26 as viewed from above. The movable platform 50 is preferably attached by means of a collar 51 to a hydraulic, telescoping cylinder 52 which is controlled through a set of controls 54 by the system operator to lift the platform 50 and bucket 26 to a desired height. The cylinder 52 is attached at its lower end to a frame of the system, schematically indicated in FIG. 3B at 53. Alternatively, more than one cylinder arrangement 51-53 may be used for a symmetrical balance of the forces involved in lifting the platform.

Figure 5:
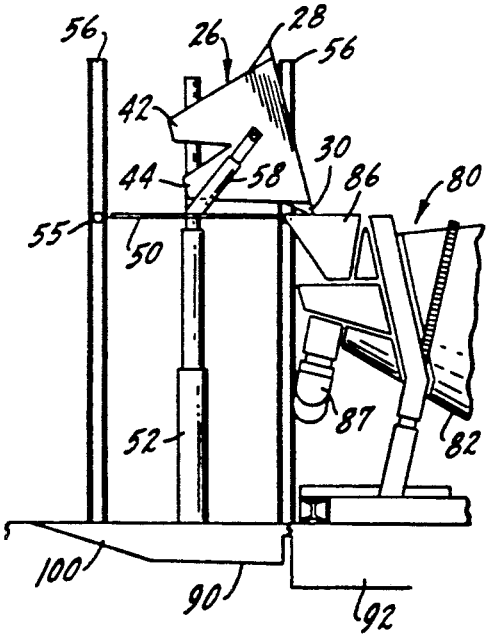
FIGS. 5 and 6 show an elevational view of the system in different phases of its operation.
Figure 6:
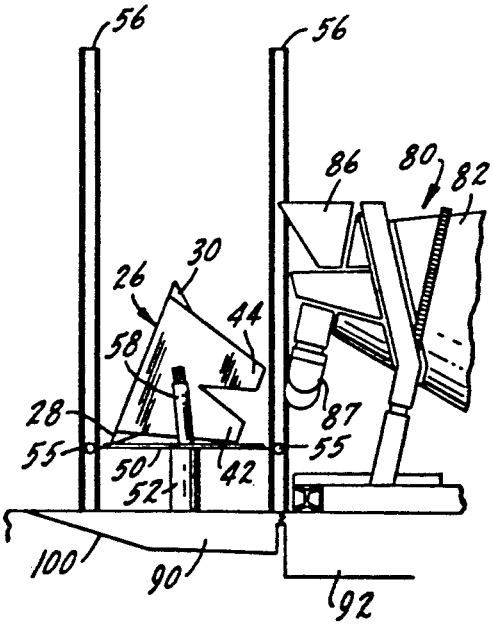

FIGS. 5 and 6 show the telescoping hydraulic cylinder 52 in partly and fully extended positions, respectively, so that the bucket contents can be emptied or cleaned at different stages of operation of the inventive method. Stationary guides 56 are disposed at the periphery of platform 50 in order to provide a safety feature during elevation of the platform 50 and the bucket 26. The guides 56 are U-shaped members which surround on three sides two rolling wheels 55 attached to each corner of the platform 50 by means of rolling wheel guide brackets 57. The sets of rolling wheels travel within and along guides 56 to maintain the platform 50 in a level position during operation.

A set of dual acting hydraulic cylinders 58, also referred to as hydraulic arms, one of which is shown in FIGS. 1, 3A, 3D and 4-6, are attached to the platform 50. Activation of the dual acting hydraulic cylinders 58 tilts the bucket 26 to a position approximately 90° to the position when bucket 26 is in an upright position. Tilting the bucket 26 to the position shown in FIGS. 3D and 5 causes the concrete to pour out of the bucket 26 by means of one of the spouts 28,30, depending on the direction which bucket 26 is tilted.

The dual-acting hydraulic arm cylinders 58 can tip the material handling bucket 26 to the right or left, as shown in FIGS. 1, 3D and 4-6 and as described below, depending on the direction in which the material in bucket 26 is desired for discharge. The cylinders 58 can be activated to tilt the bucket 26 in any of a number of different angle positions, thus discharging some or all of the contents of bucket 26, as desired. Following the discharge, the cylinders 58 once again lower the bucket 26 to an upright position, as shown in FIGS. 3A and 3B.

The cylinders 58 are hydraulically operated and also provide a stabilizing function to the bucket 26 that prevents the bucket and contents from discharging completely when such discharge is undesirable. For example, as bucket 26 is tilted by hydraulic arms 58, the approximate center of gravity will extend laterally beyond the point of support of the bucket 26, indicated by the pivot point P in FIG. 3D. In such a case, the bucket would overturn uncontrollably but for the supporting function of hydraulic cylinder arms 58 and the supports 60.

An important feature of the operation of bucket 26 is that tilting of the bucket 26 by arms 58 must be performed during simultaneous engagement of the bucket on the platform 50. The engagement must be ensured to prevent the bucket 26 from disengaging from the platform and tumbling down from the platform 50 when in a raised position. To facilitate the engagement of bucket 26 to platform 50, supports 60, best illustrated in FIGS. 3A and 3D, pivotally attached on the platform 50 are disposed at appropriate corners of the base of the bucket 26. Supports 60 may have any appropriate shape, but should be firmly attached to the top surface of the platform 50 by a strong and reliable attachment, such as by welding. The support 60 must be strong enough to withstand great forces, both direct and torque forces, as the bucket 26 is rotated about the support 60.

Each support 60 includes a pin-receiving opening 62. Two supports 60 and pin-receiving openings 62 form a pair, such that the centerlines of the circular openings 62 of a support pair are aligned. The other two supports 60' form a second support pair with openings 62' having aligned centerlines. Together the two openings of a pair of supports 60 define a pivot axis P about which the bucket 26 rotates, and the other support pair 60' have the aligned openings 62' which form a second pivot axis P'. The bucket 26 may rotate in opposite directions around either of the two pivot axes, P or P', depending upon which direction the bucket is to be tilted.

Only one pair of supports 60,60' and openings 62,62' may act as a pivot axis, either P or P', at a time. A pin locking mechanism is provided which is disposed on each spout wall 32,34 by which the bucket 26 engages the openings 62 or 62' of supports 60 or 60' to form pivot axis P or P', respectively.

The system provides for only one pin locking mechanism to be actuated at a time and the engagement of one mechanism automatically disengages the other. The pin locking mechanism will be more fully described below.

FIG. 3B illustrates a preferable pin locking mechanism 64' for engaging and disengaging the pivot axis P' formed by openings 62' of supports 60'. An identical pin locking mechanism 64 is disposed on the opposite spout wall 32 for engaging and disengaging the pivot axis P formed by openings 62 disposed in support 60. (Mechanism 64 is not visible in FIG. 3B.)

Each of the pivot-engaging mechanisms 64,64' comprises two locking pin-receiving modules 66 firmly attached to or integral with the respective spout wall 32,34. FIG. 3B illustrates a pair of modules 66, each having two parallel tab members 68 which are attached to the spout wall 34. Similar modules 66 are attached to spout walls 32. Each tab member 68 includes an aperture 70. All of the apertures 70 of the tab members 68 are aligned so that they have a common centerline, as shown. When the bucket 26 is in an upright position and it is in its proper lateral position on the platform 50, the centerline of the apertures 70 and the centerline of holes 62' are both aligned. In the preferred embodiment, a cylindrical tube 72 is disposed between each of the two tab members 68 so that the inside diameter of each tube 72 is concentric with the apertures 70 and a passageway is formed through each pin-receiving module 66 by the apertures 70 and the inner diameter of the tube 72.

The mechanisms 64,64' further comprise cylindrical locking pins 74 which extend through each passageway formed in pin-receiving modules 66. The pins 74 are translatable through the passageway in a lateral direction. Each of the pins 74 are connected to one end of a translation shaft 76 by a flexible hinge bolt and nut assembly 75 that permits angular rotation between pin 74 and the end of shaft 76. A similar hinge bolt and nut assembly 77 attaches the other end of shaft 76 to a lever 78. Assembly 77 also permits angular rotation between the shaft 76 and lever 78.

Lever 78 is attached to the spout wall 34 by a third bolt and nut assembly 79, or alternatively, by a boss and rod assembly 79. The bolt or rod of assembly 74 is preferably perpendicularly attached to the spout wall 34 by welding or other means. The bolt acts as a fulcrum point for the lever 78 and the lever can freely rotate about the assembly 79 even after the nut is attached to the bolt.

After assembly of mechanism 78, rotation of the lever 78 around the fulcrum point is effectuated by bolt and nut assembly 79 which causes outward lateral translation of each shaft 76. Shaft 76 and pins 74 are connected by means of a bolt and nut assembly 75, and outward translation of the shaft 76 and also causes outward lateral translation of each of the pins 79 through the passageway formed by module 66. Pins 74 will then extend beyond the edge corners of the bucket 26 formed by the walls 34,38 and 34,40, respectively. Proper alignment of apertures 70 with the holes 62' permits pins 74 to be inserted within holes 62'. Conversely, counterclockwise rotation of the lever 78 will cause inward translation of the shaft 76 and pins 74 and the retraction of the pins 74 from holes 62'. Complete retraction of pins 74 will provide clearance for transposing the walls 38,40 past the supports 60'.

Figure 4:
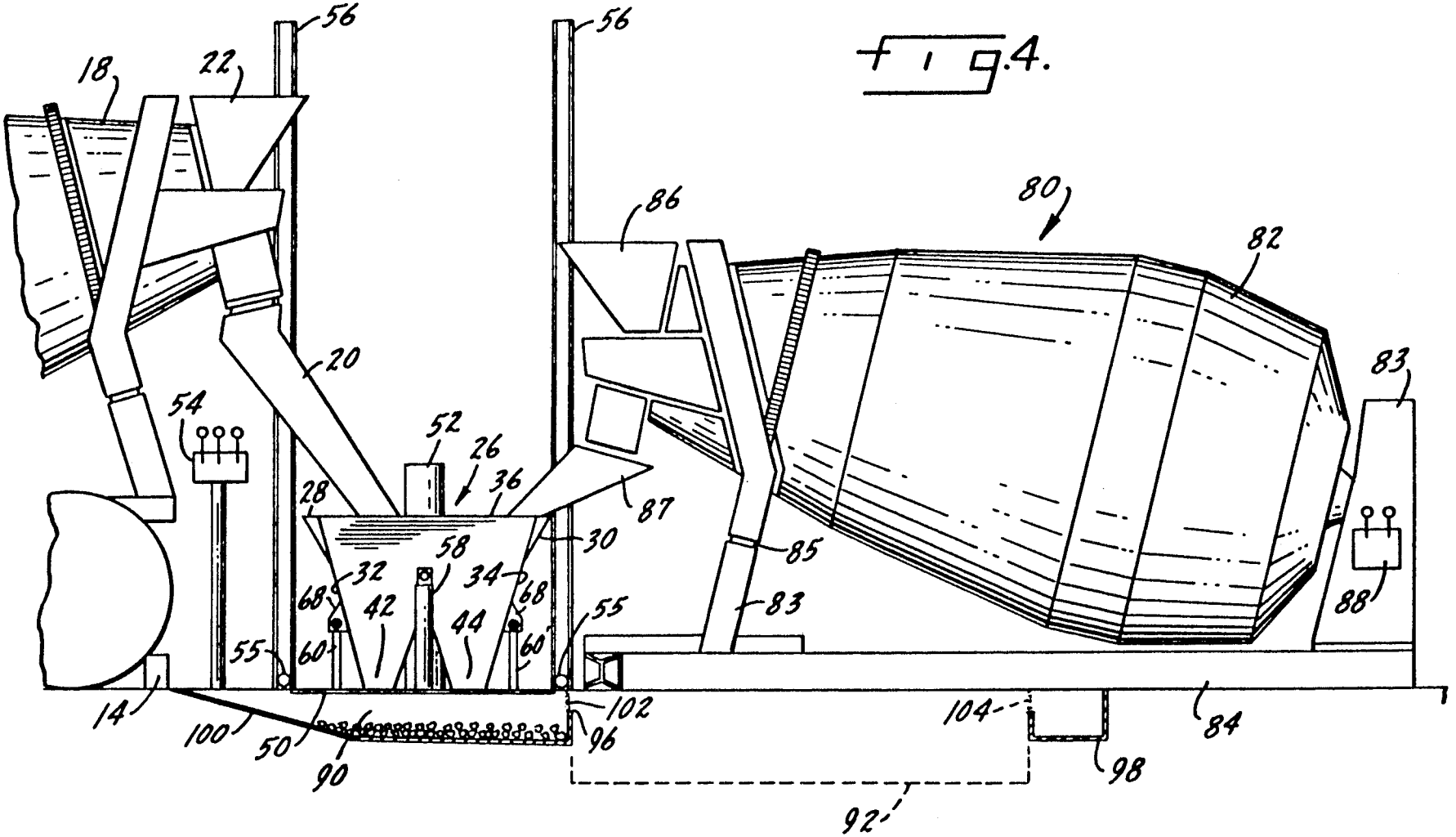
FIG. 4 is a detailed view of the system according to the present invention showing the rinse water settling trays in partial cross section.

Rotation of lever 78 is effectuated by a hydraulic cylinder 81' which is attached to the spout wall 34 and which is controlled by controls 54 (FIGS. 1,4). Controls 54 operate both the hydraulic cylinder 81' disposed on wall 34, as shown in FIG. 3B, and also another cylinder 81 (not shown in FIG. 3B) disposed on the opposite spout wall 32. Each hydraulic cylinder 81,81' is attached to the respective levers 78 by means of a boss and rod attachment which also provides angular rotation in the attachment to one end of lever 78.

The controls 54 operate the hydraulic cylinders 81,81' in synchronous relation and always actuate the hydraulic cylinders 81,81' in opposite directions. For example, when hydraulic cylinder 81' translates the pins 74 outwardly so that pins 74 engage holes 62' to create a pivot axis P', the system causes cylinder 81 to simultaneously operate to retract pins 74 from holes 62, thus disengaging pivot axis P. Accordingly, a failsafe system is provided so that only one pivot axis, P or P', is engaged and operable at any one time.

Now the operation of the bucket 26 and platform 50 will be described. Operation of the bucket 26 to load and to discharge concrete is fairly simple. The bucket 26 is loaded when it is in the upright position, as shown in FIG. 4. In this position, one of the pivot axes, P or P', is operational as either one of the mechanisms 64 or 64' has engaged the pins 74 into the support holes 62 or 62', respectively. The hydraulic arms 58 are in the retracted position, thus providing at least four points of support of the bucket 26 to the platform 50. These points are the two defined by one pair of supports, either 60 or 60', and the connection points R,R' of the arms 58 to the bucket walls 38,40 formed by assemblies 59, comprising rod and boss assemblies 59, one of which is shown. The rods of the assemblies 59 are firmly attached to an appropriate point R,R' on the bucket walls 38,40 by welding or other means.

The second hydraulic arm (not shown in FIGS. 3A,3D) provides another point R of support for symmetry, but may be unnecessary in certain configurations. In the upright position, it is not required that the bottom of bucket 26 rest on the platform 50, since the hydraulic arms 58 in the retracted position may maintain the bucket 26 suspended at a position slightly higher than the top surface of the platform 50 for purposes of clearance.

For unloading the bucket 26 or for discharging a portion of the contents, first a decision is made regarding the direction of discharge. Referring again to FIGS. 3A and 3D, for example, contents discharge is desired toward the left, or back toward the ready mix truck as seen in FIG. 1. The platform 50 is raised by means of the hydraulic cylinder 52. Then, the controls 54 are operated to engage pivot point P by outwardly translating the pins 74 into holes 62 and retracting the pins 74 by inwardly translating them from the holes 62'. The bucket 26 is now ready for tilting.

Controls 54 are activated to extend hydraulic arms 58 in the upward direction (FIG. 3A). As the arms 58 are extended, the bucket 26 begins to rotate about the pivot axis P which has been effectuated by the insertion of pins 74 into support holes 62 by the hydraulic mechanism 64. The body of the bucket 26 then acts as a lever and rotates counterclockwise about the pivot axis P, so that the connection points R are rotated in the direction of the dashed arc C (FIG. 3D). It should be noted that as the connection point R moves upward, the bucket 26 is forced to tilt because of the restraint asserted by the support 60 and pivot axis P which acts as a fulcrum in a third class lever arrangement. The hydraulic arms 58 provide a moment to the bucket 26 as they extend upwardly. Because of the magnitude of the weight and forces acting on the fulcrum of pivot axis P, it will be appreciated that the supports 60,60' must be made of a sturdy material able to withstand the weight and forces exerted. Steel having a high tensile strength is appropriate for the supports and the connection assemblies.

As bucket 26 is tilted, the fluid contents of the bucket, such as mixed concrete, will be channeled to flow from the spout 28 and into the receptacle, such as a truck hopper 22 (FIG. 1), disposed immediately below the spout. The shape of bucket 26, as shown in cross section in FIG. 3C, provides the appropriate shape to cause all of the contents of bucket 26 to discharge. The W-shaped bottom of the bucket permits both troughs 42,44 to empty simultaneously when the bucket is tilted, and the steep angles formed by the inside trough walls 43,45 urge the discharge of the contents.

When the desired discharge from bucket 26 is completed, retraction of the hydraulic arm 58 then rotates the bucket 26 in the clockwise direction. The connection points R again are transposed through an arc C, but in the opposite direction, until the bucket 26 is again in the upright position.

For tilting the bucket 26 in the opposite direction for discharge of the contents toward the right, as seen in FIG. 3A, the pivot axis P is disengaged and the opposite pivot point P' is engaged. The extension of arm 58 will provide a moment in the opposite direction and tilt the bucket 26 in clockwise direction for discharge from the other spout 30.

As will be appreciated by a person of ordinary skill in the art, the dimensions and configuration of the supports 60,60', support holes 62,62', tabs 68 and apertures 70, hydraulic arm 58 and location of the connection point R is critical to the proper operation of the device. For example, if the support 60 in FIG. 3D is too tall relative to the width of the bottom of the bucket 26, the tilting of the bucket will fail to proceed completely and rotation of the bucket to a perpendicular position will not be possible, thus failing in the discharge of the contents.

Conversely, if the support is too short, or the hydraulic arm 58 has a stroke which extends the connection point R too far, the bucket will no longer be able to function as a lever because the fulcrum pivot axis P will be between the connection points R and the connection of arm 58 to the platform 50. Thus, when contraction of the arm 58 is attempted, the arm will exert countervailing forces and will be unable to rotate the bucket 26. Preferred dimensions for these parameters for a bucket 26 having a generally pyramidal shape and able to contain approximately two cubic yards are as follows. The base or bottom of bucket 26 should be about 32 inches long and about 32 inches wide. The angle of the slope of spout walls 32 or 34 should be from approximately 10° to approximately 25° from vertical. The support hole 62,62' should be about 12 inches high from the platform 50, the connection point R should be about 30 inches from the platform when the bucket is upright (FIGS. 3A,3B) and the fully extended stroke of the hydraulic arm should be about 52 inches.

The materials comprising the platform assembly and bucket 26 should be very sturdy and able to withstand great stresses placed on them by operation of the device. Steel or other metals having high tensile strength is appropriate, but certain of the elements, such as rolling wheels 55, may comprise other materials not being particularly sturdy. Such materials may be hardened plastic or other appropriate metals.

After the concrete is discharged from the material handling bucket 26, the concrete enters the storage or stationary mounted mixer assembly 80 of the system 10. Storage assembly 80 comprises a rotatable, stationary mixer 82, similar to the truck mixer 18, which is mounted at or near grade level by means of a mounting assembly, which comprises struts 83, a platform 84 and a mounted hydraulic system drive 85. The drive 85 may receive power from an electric motor, a pony engine or other appropriate drive means (not shown).

The storage assembly 80 further includes a hopper 86 and a concrete guide chute 87 which provide for ingress to and egress from the mixer 82 of the concrete. The stationary mounted mixer 82 may be controlled by the controls 54 which also control the elevated platform 50 and which tilt the bucket 26. Alternatively, a separate set of controls 88 may be provided which can provide for starting and stopping of the hydraulic system drive 85 to rotate the mixer 82, for raising and lowering the mixer 82 in order to permit concrete discharge, and for other necessary control functions.

Use of a stationary mounted mixer assembly 80 is not an absolute necessity. For example, a truck mounted mixer, such as mixer 18, may be utilized to store returned concrete from a number of other trucks for a short period of time, such as overnight. A truck mounted storage system may be more appropriate if the concrete is being stored at the construction site or at a concrete mixing plant in which space is not available for a stationary ground mounted mixer assembly 80. A truck mounted mixer can also be used on occasions when the stationary mixer 82 becomes full because of an unanticipated amount of concrete having been returned in a particular day.

The system 10 can be housed permanently in a ready-mix plant, or portions of it may be mobile for use at various sites. For example, in the case where it is desired to store unused concrete at a construction job site, the essential portions of the material handling system 10, such as the material handling bucket 26 and hydraulic platform assembly 50-59, can be made mobile and transported to the construction site. Disconnecting hydraulic cylinder 52 from the platform 50 is accomplished by removal of collar 51. Mobility may then be effected by mounting the platform assembly 50-59 on a flatbed mounted on wheels (not shown) so that the assembly may be connected to the rear of a ready mix truck through a tandem trailer arrangement. The mobile assembly may include means for handling the residue concrete constituents, such as portable versions of settling trays described below.

Referring again to FIGS. 1, 2 and 4, system 10 further includes a series of settling trays or slurry pit trays 90,92 and a water storage tank 94 which are connected in series by conduit or appropriate apertures 96,98. After the concrete is discharged from the truck mixer 18 and the bucket 26, a stream of water is used to rinse out the receptacles, and the rinse water is emptied into the first settling tray 90. FIG. 6 shows the bucket 26 in a position for emptying out the rinse water.

FIGS. 1, 2 and 4 show the settling trays 90,92 and water storage tank 94 preferably being disposed beneath and adjacent the bucket 26 and storage assembly 80. This is convenient to a ready mix plant for space conservation reasons, but is not necessary if sufficient space is available in the plant away from the concrete storage assembly 80, in which case adjacent disposition of trays 90,92 and tank 94 is possible.

The trays 90,92 and tank 94 are shown in FIG. 1 to be at different levels relative to each other. Such a construction facilitates movement of slurry between the separate trays by means of gravity. Alternatively, pumps (not shown) may be used to pump slurry water from the trays 90,92 through the system First settling tray 90 has a sloping bottom wall 100 which forms an appropriate cavity for settling out of sand and stone from the rinse water. Conduit or aperture 96 then permits the remaining slurry to enter the second settling or slurry pit tray 92. An appropriate filter, such as a wire mesh screen 102, may be disposed within the conduit or aperture 96 so that no particles greater than a predetermined size may enter the slurry pit tray 92.

Slurry tray pit 92 is normally wider and deeper than the first settling tray 90 and can have at least twice the available volume. This permits the settling of finer particles from the slurry and also permits water from the slurry to pass through the second conduit or aperture 98 into the rinse water storage tank 94. Alternatively, pumps (not shown) in each of the settling tanks provide a means for removing the material contained in each for reuse in the batching of new concrete when required.

The method of operation of the system provides for a quick, easy, efficient storage and reclamation process which virtually eliminates any waste and effectively reuses all of the constituent components of the mixed concrete and the rinse water. Operation of the system 10 begins with the arrival of a ready mix truck 16 to a concrete mixing plant. The truck 16 contains a portion of concrete which has been returned from a construction site because the concrete was unneeded. At the end of the day, no further pouring of concrete for the truck 16 is contemplated, and the concrete must be removed from the truck mixer 18 before the concrete sets. The mixer 18 must also be rinsed with water to remove concrete that has adhered to the walls of the mixer.

The truck 16 can either back up to the dock 12 in the concrete mixing plant until its back wheels abut guide 14, or it can pull up alongside the material handling bucket 26. Unused concrete is then discharged from the mixer 18 by the operator who can utilize controls 24 to cause the concrete to pour from mixer 18 through chute 20 into bucket 26. The amount of concrete in the bucket 26 is then measured, either by weighing or by observation of the concrete volume in the bucket 26 relative to the incremental indicators 48 which are marked on the inside walls of the bucket 26.

As is discussed above, measurement of the amount of concrete is necessary to give an indication of the proportionate amount of hydration retarding agent and hydration accelerating agent which is required for the period of time, whether hours or days, that the unused concrete will be stored. The operation of controls 54 by the operator causes the hydraulic telescoping cylinder or cylinders 52 to raise the platform 50, on which rests bucket 26 in an upright position, to a height slightly above the height of hopper 86, as shown in FIG. 5. The controls 54 then direct that dual action hydraulic cylinders 58 to tilt the bucket 26 to pour the concrete in the bucket into the hopper 86 and into stationary mounted mixer 82. Release of the controls 54 will return the bucket 26 back to an upright position. Further operation of controls 54 will lower platform 50 and bucket 26 to ground level.

At this point, a deactivator or hydration retarding agent is added to the concrete mixture either directly or by a carrier. It has been found that adding the deactivator to water acting as a carrier provides a fairly accurate means to measure the amount of deactivator needed for a particular batch of returned concrete. The amount of deactivator needed can be easily calculated when certain information relating to the concrete to be stored is known. The amount, age, temperature, design of the mix and the expected period of time for which the concrete will be stored all enter into the equation to determine the amount of deactivator necessary for a particular batch of concrete. A fairly accurate method of calculating the amount of a specific deactivator needed is described in the aforementioned U.S. Pat. No. 4,964,917.

After the proper amount of deactivator is added to the concrete in stationary mounted mixer 82, the operator begins rotation of the mixer 82 by activating the appropriate controls 54 or 88, which engage the hydraulic system drive 85. Rotation of mixer 82 continues until the concrete and deactivator are thoroughly intermixed. The rotation of mixer 82 can then cease, as the concrete in the mixer will be deactivated and will not set for the predetermined amount of time previously calculated.

At this point, a certain amount of rinse water can be pumped out of water storage tank 94, where it has previously settled, as will be explained below. A predetermined amount of water is used to rinse out the ready mix truck mixer 18 of any ready mix concrete residue which has not been previously discharged. After the rinsing cycle of the mixer 18 is completed, and the mixer 18 is cleaned, the rinse water is discharged into the bucket 26. The rinse water discharged from mixer 18 can be used to rinse out the bucket 26.

The rinse water can then be dumped from bucket 26 at ground level, as shown in FIG. 6, into the first settling tray 90 where the residue of sand and stones will settle out along the sloping wall 100 and the bottom wall of the settling tray 90. The remainder of the water in a slurry form will then flow through the conduit or aperture 96 and into the second or slurry settling tray 92. An optional screen 102 can be interposed within conduit or aperture 96 for filtering out stones which are greater than a predetermined size. Such a screen is not always necessary because the slower rate of slurry ingress into slurry settling tray 92 will avoid the turbulence that might cause a stone of greater size to reach the aperture 96, which is somewhat higher than the floor of tray 90.

The same procedure is repeated for the slurry in settling tray or slurry tray 92, and the sand and fine particles settle out of the slurry along the floor of tray 92. A stream comprising essentially water will then flow through conduit or aperture 98 into the water storage tank 94, where it can be reused for rinse water in the next cycle of rinsing.

A screen 104 can be disposed in aperture 98 for further filtration of the slurry water, the screen 104 being of a finer mesh material than screen 102. Thus, the screen 104 can filter out finer solid particles than can screen 102. Alternatively, such a screen may be omitted because the increased depth of a second settling tray 92 will deter the fine solid particles from flowing to the height of the aperture 98 and into water storage tank 94.

At this point in the operation, the bucket 26 is clean and ready to accept further concrete discharge returned by a different ready mix truck. The first truck 16 is also empty of concrete and has been rinsed out. The clean truck 16 is then ready for reloading of new concrete mix or the truck 16 can be taken out of service for the day. The process can be repeated for as many times as is necessary until either all of the plant ready mix trucks have been placed out of service for the day or until the stationary mounted mixer 82 becomes full and can no longer accept any more ready mix concrete. If the stationary mounted mixer 82 becomes full, a truck mounted mixer can be utilized to store excess deactivated concrete, as has been described above. The concrete is then stored in the deactivated state in the mixer 82 and/or the truck mounted mixer (not shown) overnight for as many days as has been anticipated when the calculation of the amount of deactivator to be added was made. Alternatively, a bank of stationary mixers 82 may be set up in close proximity and the platform assembly 50-59 may be on a rail system (not shown) which allows movement from one of the mixers 82 to another.

When there is again a use for the stored ready mix concrete, the operator activates the controls 54 or 88, beginning rotation of the mixer 82 and discharging a predetermined and measured amount of ready mix concrete into the bucket 26, which is upright at ground level as shown in FIG. 1. A truck 16 is then positioned on the dock 12 in a position identical to that when the truck discharged the concrete into the bucket 26. The operator then engages the hydraulic telescoping cylinder 52 by using controls 54 and raises the platform 50 and bucket 26 adjacent the truck hopper 22. The operator then engages a dump valve on controls 54 to begin operation of the engagement of the lock pin mechanism 64 or 64' and of the dual-acting hydraulic cylinders 58.

Dual acting hydraulic cylinders 58 are operable to tilt bucket 26 in either direction, depending on the operation of the controls 54 and whether pivot axis P or P' is engaged. In this stage of operation, the bucket 26 is tilted toward the truck hopper 22, thus causing the concrete in bucket 26 to pour into hopper 22 by means of bucket spout 28. As described above, the unique construction of the bucket 26 ensures the almost complete emptying of the concrete into the hopper 22 and eventually into the truck mixer 18. The bucket 26 is then returned by cylinders 58 to an upright position and the bucket is lowered together with platform 50 to ground level for cleaning or future loading.

To accelerate the retardation of the hydration process, a predetermined amount of an appropriate activating agent is delivered to the truck mixer 18 or to the concrete in the bucket 26, preferably by means of a carrying agent such as water. The amount of activator needed for a particular amount of concrete may also be calculated according to a formula, such as that disclosed by aforementioned U.S. Pat. No. 4,964,917, and utilizing the measurement of bucket contents provided by incremental indicators 48.

The batch of concrete loaded into truck mixer 18 from the storage mixer 82 may be sufficient to deliver directly to the construction site. However, it has been found preferable to add a newly mixed concrete mixture into the mixer 18, including fresh water and other necessary constituents, together with the reactivated mixture taken from the storage mixer 82. Mixing new and reused concrete together has been found to more closely correspond to concrete which is mixed only from fresh constituents. This enables the characteristics of the reused concrete to be better known and to permit less diligent monitoring of the reused concrete mixture at the construction site.

After the truck mixer 18 is rotated and in the process mixes the reused and new batch of concrete, the concrete is ready for delivery to the job site. In the meantime, after all of the stored concrete is emptied out of the stationary mounted mixer 82, it can be rinsed out and the rinse water may be emptied into the bucket 26, rinsing out the bucket in the process. The bucket 26 is then emptied into the first settling tray 90, in a similar procedure to that performed at the end of the day which is discussed above. After the rinse, the bucket 26 and the concrete storage assembly 80 are clean and ready for reuse.

One advantage of using this system is that all of the constituent elements which go into making the fresh concrete mix can be recycled from each of the settling trays 90,92 and water storage tank 94. For example, stones from tray 90, sand from tray 92 and water from water storage tank 94 can each be added to the stored mixture. Alternating the stored sand and slurry may be partially used for making a batch of fresh concrete without great regard for the homogeneity of each constituent material. Small portions of stones in which sand is intermixed, or of water which includes certain concrete constituent impurities, will not affect the overall mix of a large batch of concrete which has mostly fresh metered amounts of constituents. One advantage of having separated the constituents is that they will not set into a hardened concrete block. It is an added feature that any impurities in each of the recycled constituents were originally found in the concrete residue, and will not create a problem in the mixing of a fresh batch of concrete mix.

A preferred method for reusing the constituents in the settling trays has been found to consist of the following steps. At the end of the storage assembly loading procedure, or whenever necessary, the contents of the first settling tray 90 and the second settling tray 92 is emptied into the bucket 26 by use of manual unloading wheel loader or pumps (not shown). The bucket 26 is then raised by the telescoping hydraulic cylinder or cylinders 52 and its contents are discharged into the stationary mounted mixer 82, together with any concrete that is being stored in the mixer 82. Rotation of the mixer 82 mixes all of the materials together into a homogeneous concrete mix.

Water from water storage tank 94 may be continually reused in a closed system for rinsing, especially since only small amounts of the water will be lost due to evaporation. Occasional discharge of this water into a mixing batch of concrete will inhibit the collection of excess impurities in the water storage tank 94. Occasional fresh water infusion into the closed system will clean out all of the settling trays 90,92 and 94. This closed system for each of the constituents is especially useful to the operation of a concrete mixing plant in jurisdictions which prohibit the discharge of rinse water or other constituents into the sewer system or on the ground due to environmental concerns. Another feature of this system is that no water is wasted, and all of the constituent materials of the concrete are recycled.

Other variations of the preferred system and method will become apparent to a person of ordinary skill in the art once a full understanding of the present invention is had. For example, a common hydraulic reservoir (not shown) could be used for lifting of the platform 50 and for driving the mounted hydraulic drive 85. Different elevations can be provided for different elements of the system to reduce lift heights and points of charge and discharge. The size of the material handling bucket 26 can be customized to the end user's requirements. The material handling bucket can in the alternative be mounted on load cells (not shown), as well as a stationary mounted mixer 82, so that weight of constituents could be used for calculations and mixing the volume. Other types of drives or lifting capability may be used for the platform 50, such as a chain fall or cable and I-beam system.

Another alternative may be provided to the settling trays and pits 90,92,94. A holding system may be provided in a first hopper 86 having appropriate drains for settling out of the sediments in the first hopper 86. The slurry from the first hopper 86 may be poured into a second hopper (not shown). The sediments taken from the first hopper 86 are then dried out or stored for future use, such as with the next day's concrete batch. The poured slurry mixture may then be allowed to settle out in the second hopper, following which the water is drained off to flow into a holding tank, such as tank 94, which may be above ground. The water in the holding tank may be reused in making a new batch of concrete. The dried remnants of the slurry mixture also may be used in making a new batch of concrete by adding the dried powder to a new mixing batch.

The system may also be used in an alternative capacity as a material transfer system. For example, if a mixer truck becomes disabled and must discharge its mixed concrete contents, the system 10, or simply the material-handling bucket 26 and platform assembly 50–59, may be utilized to transfer the material from the disabled truck to a truck which is operational.

Other alternative embodiments and variations are possible. Accordingly, the foregoing embodiments are described as being illustrative and not limiting, the scope of the invention being limited only by the following claims.

What is claimed is:

1. A system for reclaiming unused portions of mixed concrete comprising:

a) unloading means for discharging the unused portions of concrete from a movable container;

b) a material handling bucket for receiving the unused portions of concrete from said unloading means;

c) means for elevating and lowering said material handling bucket;

d) means for automatically tilting said material handling bucket and for pouring the concrete contained by said material handling bucket to a desired location;

e) means for adding a chemical agent to said unused concrete to change the hydration state of the concrete;

f) at least one storage mixer for receiving the unused concrete from said material handling bucket and for storing the unused concrete, said mixer being capable of revolving;

g) means for revolving said mixer and causing said chemical agent to homogeneously mix with the concrete in said at least one storage mixer; and h) means for discharging the concrete from said storage mixer into said material handling bucket and for loading the concrete into a desired receptacle.

2. The system for reclaiming unused portions of mixed concrete according to claim 1 wherein said elevating means comprises a hydraulic lift.

3. The system for reclaiming unused portions of mixed concrete according to claim 2 wherein said hydraulic lift further comprises at least one hydraulic telescopic cylinder.

4. The system for reclaiming unused portions of mixed concrete according to claim 1 wherein said means for automatically tilting said material handling bucket comprises dual acting hydraulic cylinders.

5. The system for reclaiming unused portions of mixed concrete according to claim 1 wherein said storage mixer comprises a stationary mounted mixer.

6. The system for reclaiming unused portions of mixed concrete according to claim 1 wherein said storage mixer comprises a truck mounted mixer.

7. The system for reclaiming unused portions of mixed concrete according to claim 1 wherein said material handling bucket essentially comprises a truncated pyramidal shape with the base defining the top of the bucket, said base having an opening for loading and discharging the concrete from said bucket.

8. The system for reclaiming unused portions of mixed concrete according to claim 7 wherein said bucket further comprises at least two spouts, one each disposed at opposite side walls of said bucket along the periphery of said base opening for facilitating the discharge of the concrete in oppositely disposed directions.

9. The system for reclaiming unused portions of mixed concrete according to claim 8 wherein the material handling bucket further comprises two troughs, each longitudinally disposed along at least one said side wall having a spout, each trough being further defined by inside trough walls extending upwardly from the bottom of said bucket and being longitudinal adjacent each other.

10. The system for reclaiming unused portions of mixed concrete according to claim 9 wherein said troughs are parallel to each other and the longitudinal ends of each trough are defined by oppositely disposed side walls of said bucket, said side walls of said bucket being other than the walls including said spouts.

11. The system for reclaiming unused portions of mixed concrete according to claim 1 wherein said bucket further comprises at least two spouts, one each disposed at opposite side walls of said bucket, said at least two spouts being disposed along the periphery of said base opening for facilitating the discharge of the concrete in oppositely disposed directions.

12. The system for reclaiming unused portions of mixed concrete according to claim 2 wherein said elevating means includes a platform capable of being raised and lowered by a hydraulic lift, and the material handling bucket being connected to said platform and being capable of rotational transposition with respect thereto.

13. The system for reclaiming unused portions of mixed concrete according to claim 12 wherein said means for automatically tilting said material handling bucket comprises at least one set of hydraulically actuated locking pins which engage a support means disposed adjacent the corners of said platform and connected thereto, at least two of said support means further including pin-receiving apertures for receiving at least two of said hydraulically actuated locking pins, said two support means and apertures being aligned, and said at least two apertures and said at least two hydraulically actuated pins together defining a pivot axis about which said material handling bucket can tilt and rotate with respect to said platform.

14. The system for reclaiming unused portions of mixed concrete according to claim 13 wherein said means for automatically tilting said material handling bucket further comprises two sets of hydraulically actuated locking pins and a second pivot axis comprising at least two additional support means adjacent to the corners of said platform opposed to the corners adjacent said at least two support means, said additional support means being connected to said opposed corners, so that said material handling bucket may be tilted about either one of said pivot axes depending on the particular set of said locking pins which are actuated in the respective supports.

15. The system for reclaiming unused portions of mixed concrete according to claim 12 wherein said hydraulically lifted platform further comprises guides disposed at the corners thereof for stabilizing the platform during lifting and lowering.

16. A method for storing and reclaiming unused portions of concrete comprising:

a) discharging the unused portions of concrete from a container into a material handling bucket when said material handling bucket is in an upright position;
b) adding a chemical agent to the concrete to change the hydration state of the concrete;
c) elevating said material handling bucket to a predetermined level;
d) automatically tilting said material handling bucket and discharging the concrete contained in said material handling bucket into at least one storage mixer which is capable of revolving;
e) revolving said storage mixer so that said chemical agent is homogeneously dispersed throughout the concrete in said storage mixer;
f) storing the unused portions of the concrete in said storage mixer for a predetermined length of time;
g) adding a chemical agent to the concrete to accelerate the hydration state of the concrete;
h) revolving said concrete so that said accelerating agent is homogeneously dispersed throughout the concrete in said storage mixer; and
i) utilizing said accelerated hydration state concrete as a normal batch of concrete.

17. The method for storing and reclaiming unused portions of concrete according to claim 16, wherein the steps b) and f) in which chemical agent is added further each comprise dissolving said chemical agent in a carrier, and then adding said chemical agent with said carrier.

18. The method for storing and reclaiming unused portions of concrete according to claim 16 wherein the tilting of said material handling bucket is performed by dual acting hydraulic cylinders.

19. A material handling bucket for use in a system for reclaiming unused portions of mixed concrete comprising:

a) two spout walls defined by two opposing walls including a spout extending outwardly from each of said spout walls;
b) two additional opposing walls defining connection walls providing a central connection point on said connection walls for connecting hydraulic arms to said central connection point;
c) at least two sloping trough walls being substantially shorter than said spout walls, said trough walls being attached to said connection walls, one of said spout walls and one of said trough walls defining a first trough and the other of said spout walls and the other of said trough walls defining a second trough, each of the connection walls closing off each end of said first and second troughs.

20. The material handling bucket according to claim 19 wherein at least one of said spout walls further comprises a hydraulically actuated locking pin mechanism for releasably engaging outer support members not otherwise attached to said material handling bucket, whereby engagement of said locking pin mechanism in said outer support members provides a pivot axis about which said bucket is rotatable for tilting and discharging material, and whereby transposing of said connecting point by said hydraulic arms provides a moment to said bucket for rotation about said pivot axis.

21. The material handling bucket according to claim 20 wherein both spout walls further comprise a hydraulically actuated locking pin mechanism for engaging support members on opposite sides of said bucket, whereby a pivot axis can be engaged adjacent either spout wall for rotating said bucket in either a clockwise or counterclockwise rotation, thereby discharging the material in said bucket from the desired one of said spouts.

* * * * *